United States Patent [19]

Berkestad et al.

[11] 3,944,221

[45] Mar. 16, 1976

[54] RESISTANCE DEVICE FOR A GYMNASTICS APPARATUS

[76] Inventors: Karl-Erik Berkestad, Skattegarden 34, S-582 41 Linkoping; Lars Göran Torgny Börjesson, Ravinvagen 17, S-595 00 Mjolby, both of Sweden

[22] Filed: Mar. 11, 1974

[21] Appl. No.: 450,181

[30] Foreign Application Priority Data

Mar. 12, 1973 Sweden ..... 7303385

[52] U.S. Cl. ..... 272/79 C

[51] Int. Cl.[2] ..... A63B 21/00

[58] Field of Search ..... 272/79 R, 79 C, 80

[56] References Cited

UNITED STATES PATENTS 767,008 8/1904 Pelletier et al. ..... 272/79 C 3,471,145 10/1969 Berger ..... 272/79 C

OTHER PUBLICATIONS

Coleman Camp Stove, Sears Catalog, 1969, p. 862.

*Primary Examiner*—Paul E. Shapiro

*Attorney, Agent, or Firm*—Ostrolenk, Faber, Gerb & Soffen

[57] ABSTRACT

Resistance device for a gymnastics apparatus, comprising an air cylinder and a piston which is movable inside the cylinder. The device is provided with non-return valves in such a manner that, during repeated relative movement of the piston in the cylinder, the air pressure in the device and, thereby, resistance to movement of the piston increases successively.

9 Claims, 4 Drawing Figures

RESISTANCE DEVICE FOR A GYMNASTICS APPARATUS

Many gymnastics apparatus have a built-in resistance device. These resistance devices, whose resistance is to be overcome with training, often consist of springs, elastic bands, weights, etc. Thus as a rule the size of the resistance is fixed, thereby limiting the effectiveness of the devices. The fixed resistance can be too high or too low depending on the strength of the user. A person using such a device continuously will find that his increase in strength will gradually become almost null while endurance, on the other hand, will increase greatly. This is due to the fact that effective strength training requires that the resistance be adjusted to the strength of the user so that truly great muscle tensions are guaranteed.

The present invention relates to a resistance device by means of which the above-mentioned disadvantages can be eliminated and additional advantages be obtained. The invention comprises a resistance device whose resistance to movement automatically increases in connection with repetition of such movements. In this way, it is possible to make a resistance device which can at the beginning of training, have a very low level of resistance but which increases its resistance in connection with the repetition of the movements. If so desired, e.g. in the vicinity of the maximum performance, this resistance can be returned to its lowest level, at which point the sequence can be repeated, possibly in a new type of motion with other muscles at work. This gives everyone, regardless of physical strength, effective training with good balance between endurance training and strength training. Another important advantage is that, due to the fact that training in each type of movement can be at the lowest level of resistance, a gradual softening is achieved before the resistance approaches the performance maximum. An additional advantage is that the return to the starting position is very well dampened and, thus, this process does not involve any risk or injury for the user.

Figure 1:
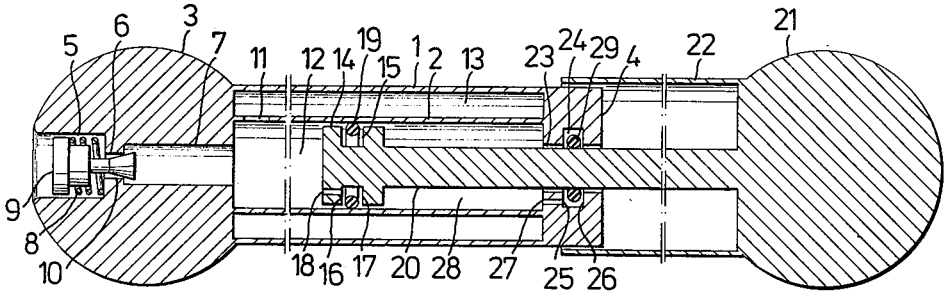
Figure 2:
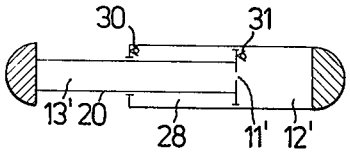
Figure 3:
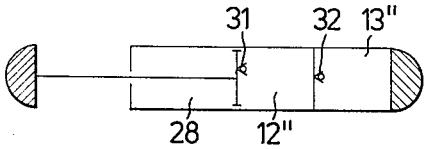
Figure 4:
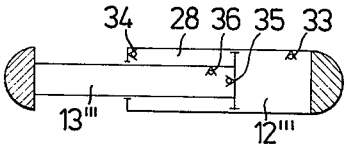

The invention is illuminated by the accompanying drawings wherein FIG. 1 shows a first embodiment of the apparatus in cross section and FIGS. 2-4 show schematically three additional embodiments.

A tube 1 and another tube 2 are at one end connected with each other by means of a spherical shaped gable 3. The tubes 1 and 2 are connected at their other ends by means of the gable 4. The gable 3 contains holes 5, 6 and 7, a spring 8, a valve body 9 and a valve seat 10. The tube is provided with a hole 11 which puts the chambers 12 and 13 in communication with one another.

In tube 2, a piston 14 is easily glidably inserted. The piston is provided with a groove 15 having sides 16 and 17. A hole 18 in the piston connects the groove 15 with the chambers 12 and 13 unhindered by the O-ring 19. The piston 14 is connected to a rod 20 which, in turn, is connected to gable 21 and the protective tube 22. Protective tube 22 can easily glide on the outside of tube 1. Rod 20 is guided in gable 4 by means of a hole 23. Hole 23 is provided with a groove 24 having sides 25 and 26. A hole 27 puts the groove 24 in connection with a chamber 28 unhindered by the O-ring 29.

The device functions in the following manner. An outer force is applied to the end members 3 and 21 in a direction towards each other. The piston 14 and the piston rod 20 glide into the pipe 2, thereby compressing the air in the chamber 12 and separate accumulating chamber 13 by means of O-ring 19 sealing against the side 17 of groove 15 and the tube 2. At the same time, air is sucked into chamber 28 via the gap between rod 20 and the hole 23, between the O-ring 29 and the groove side 26 and through the hole 27.

If the outer force is now taken away, the over-pressure in chambers 12 and 13 will press the piston out with a force which initially corresponds to the cross-sectional area of the piston 14. However, this pushing-out of the piston 14 and the rod 20 entails that the O-ring 29 is pressed against the side 26 of groove 24 and the piston rod 20, thereby compressing the air enclosed in chamber 28. When the pressure in chamber 28 is approximately as great as in chambers 12 and 13, the O-ring 19 will be pressed against the side 16 of the groove 15, so that the amount of air 28 enclosed in chamber 28 will flow into chambers 12 and 13 via the gap between piston 14 and tube 2, between side 17 of groove 15 and the O-ring 19 and through hole 18.

During this latter process, the pushing-out force is proportional to the cross-sectional area of piston rod 20 and, due to the fact that hole 18 is also a choke for the passing amount of air, the return thrust will be very well dampened. The return thrust can be accelerated by directing the outer forces in the end members 3 and 21 away from each other. If an outer force is now once again applied, the device will offer a somewhat higher resistance since the pressure of the air in chambers 12 and 13 has increased. This overpressure in chambers 12 and 13 can be reduced or completely eliminated by pressing in the valve button 9 so that it moves away from its seating 10, thereby allowing the air from the chambers 12 and 13 to pass out into the atmosphere. Spring 8 normally keeps the valve button 9 pressed against its seating 10. Thus, the resistance device initially provides a pulling resistance which, in connection with the repeated pressing together and pulling out of the end members, it successively changed to a pressure resistance which finally becomes insuperable.

FIGS. 2–4 schematically show a few additional embodiments of the resistance device according to the invention.

The device shown in FIG. 2 has, as in the one described above, dampened automatic return of piston 14. The difference lies in the fact that chamber 13' is disposed in piston rod 20, which, for this purpose, is hollow. The opening 11 between chambers 12' and 13' can form a choke which further contributes to the dampening of the movement outwards. 30 and 31 are non-return valves in one of the cylinder gables and in the piston, respectively. A further valve (not shown here) can be arranged, by means of which chambers 12' or 13' can be connected with the atmosphere. Said valve can be a manually openable valve or a valve which opens automatically at a predetermined pressure.

FIG. 3 shows an embodiment of the arrangement according to the invention, said embodiment having no or only partly automatic return or compression. In order to illustrate further variation possibilities, chamber 13 has been placed axially outside of chamber 12''. Instead of an opening or choke 11, a non-return valve 32 is arranged between chambers 12'' and 13''. Chamber 28 communicates freely with the atmosphere. A spring (not shown here) can be arranged to obtain a return movement. Further, non-return valve 32 can be choked in its opening direction in order to provide a dampened return. As in the previous embodiment, a manually openable valve or a valve having a predetermined opening pressure can also be arranged.

FIG. 4 shows an arrangement which, in contrast to the previously described arrangements, provides increased resistance in both of the pistons' directions of movement. Both of the chambers 12''' and 28' are connected with the atmosphere by means of non-return valves 33 and 34. Said chambers 12''' and 28' are also connected to another chamber 13'' in the piston rod by means of non-return valves 35 and 36. Both of the non-return valves 33 and 34 can be of the kind which can be set in an open position by means of manual influence. In this manner, it is also possible to set the arrangement so that increasing resistance is only obtained in one direction, that is, either against pressure or pull.

In FIG. 1, the outer ends of the arrangement have been formed so that they are suitable for direct manual gripping. However, a whole series of outer arrangements which are especially designed to train certain muscles is feasible. Furthermore, a series of other solutions for the construction of the resistance device is also feasible, said solutions providing the same principal effect as the solution shown and described here.

It is also possible to construct the above-described resistance device so that chamber 28 can be connected with the atmosphere via a hollow piston rod 20 and a valve in end portion 21 which can be locked in a pressed-in (open) position. The level of resistance can, herewith, be held constant at a desired level even after repeated pressing together.

What we claim is:

1. A gymnastics apparatus having a resistive device, said device comprising first and second end parts which are reciprocally movable towards and away from each other, said first end part having a first end forming an air cylinder and said second end part comprising a first end forming a piston which is movable inside said air cylinder, and a second end forming a piston rod connected to said first end, characterized in that the device is provided with a first non-return valve arranged between said piston and said cylinder and a second non-return valve arranged between said cylinder and said piston rod such that, during repeated relative movement between said first and second end parts, the air pressure in the device, and therewith, the resistance to said relative movement increases successively, and an evacuation valve provided in said first end part and in communication with said cylinder and being manually operable to reduce the air pressure in said cylinder.

2. Device according to claim 1, characterized in that the cylinder chamber on the side of the piston removed from the piston rod is in communicating connection with a separate accumulating chamber.

3. Device according to claim 2, characterized in that the cylinder chamber on the piston rod side is connected with the accumulating chamber via a choke.

4. Device according to claim 1, characterized in that the evacuation valve is a pressure-sensitive valve having an adjustable opening pressure.

5. Device according to claim 1, characterized in that the evacuation valve is a manually openable valve.

6. Device according to claim 1, further characterized in that a portion of the cylinder chamber on the piston rod side is connected with the atmosphere via said second non-return valve which opens into the same, said cylinder chamber on the side of the piston removed from the piston rod being connected with the cylinder chamber portion via said first non-return valve which opens into said cylinder chamber portion.

7. Device according to claim 1, characterized in that the cylinder chamber on the piston rod side of the piston is in communicating connection with a separate communicating chamber formed in said piston rod.

8. Device according to claim 7, characterized in that both of the cylinder chambers are connected with the atmosphere via respective non-return valves, each of said valves opening into their respective cylinder chamber, said cylinder chambers both being connected to the accumulating chamber via respective non-return valves which open into said accumulating chamber.

9. A gymnastics apparatus having a resistive device, said device comprising first and second end parts which are reciprocally movable towards and away from each other, said first end part having a first end forming an air cylinder and said second end part comprising a first end forming a piston which is movable inside said air cylinder, and a second end part forming a piston rod connected to said first end, characterized in that the device is provided with a first non-return valve arranged between said piston and said cylinder and the cylindrical chamber on the side of the piston removed from the piston rod is in communicating connection with a separate accumulating chamber via a second non-return valve which opens into said accumulating chamber and that a portion of the cylindrical chamber on the piston rod side communicates freely with the atmosphere.

* * * * *